US009281561B2

(12) United States Patent
Monte

(10) Patent No.: US 9,281,561 B2
(45) Date of Patent: Mar. 8, 2016

(54) MULTI-BAND ANTENNA SYSTEM FOR SATELLITE COMMUNICATIONS

(75) Inventor: Thomas D. Monte, Homer Glen, IL (US)

(73) Assignee: KVH Industries, Inc., Middletown, RI (US)

( * ) Notice: Subject to any disclaimer, the term of this patent is extended or adjusted under 35 U.S.C. 154(b) by 484 days.

(21) Appl. No.: 12/883,252

(22) Filed: Sep. 16, 2010

(65) Prior Publication Data

US 2011/0068988 A1 Mar. 24, 2011

Related U.S. Application Data

(60) Provisional application No. 61/244,260, filed on Sep. 21, 2009.

(51) Int. Cl.
*H01Q 3/18* (2006.01)
*H01Q 19/19* (2006.01)
*H01Q 5/45* (2015.01)

(52) U.S. Cl.
CPC . *H01Q 3/18* (2013.01); *H01Q 5/45* (2015.01); *H01Q 19/193* (2013.01)

(58) Field of Classification Search
CPC ..... H01Q 1/247; H01Q 1/288; H01Q 3/02; H01Q 3/04; H01Q 3/08; H01Q 3/10; H01Q 3/16; H01Q 3/18; H01Q 19/10; H01Q 19/12; H01Q 19/13; H01Q 19/134; H01Q 19/136; H01Q 19/17; H01Q 19/175; H01Q 19/18; H01Q 19/19; H01Q 19/192; H01Q 19/193; H01Q 25/007
USPC ..... 343/757, 758, 759, 761, 763, 766, 775, 343/779, 781 R, 781 P, 781 CA, 83, 4, 835, 343/836, 837, 839, 840, 912
See application file for complete search history.

(56) References Cited

U.S. PATENT DOCUMENTS

| | | | | |
|---|---|---|---|---|
| 3,050,701 | A | 8/1962 | Tang et al. | |
| 3,173,145 | A * | 3/1965 | Bowman | 343/777 |
| 3,305,870 | A | 2/1967 | Potter | |
| 3,569,871 | A | 3/1971 | Scotia et al. | |

(Continued)

FOREIGN PATENT DOCUMENTS

| | | | |
|---|---|---|---|
| EP | 0295812 | A2 | 12/1988 |
| EP | 1693922 | A1 | 8/2006 |

(Continued)

OTHER PUBLICATIONS

Collins, G.W., "Shaping of Subreflectors in Cassegrainian Antennas for Maximum Aperture Efficiency"; IEEE Transactions on Antennas and Propagatlon. vol. 21, No. 3 (May 1973).

(Continued)

*Primary Examiner* — Sue A Purvis
*Assistant Examiner* — Patrick Holecek
(74) *Attorney, Agent, or Firm* — Hamilton, Brook, Smith & Reynolds, P.C.

(57) ABSTRACT

The present invention provides an improved antenna system on moving platform that is in communication with multiple satellites for simultaneous reception of RF energy at multiple frequencies. The antenna is implemented as a multi-beam, multi-band antenna having a main reflector with multiple feed horns and a sub-reflector to reflect Ku and Ka frequency band signals directed by a focal region of the main reflector.

21 Claims, 7 Drawing Sheets

(56) References Cited

U.S. PATENT DOCUMENTS

| | | | | |
|---|---|---|---|---|
| 3,623,094 | A * | 11/1971 | Paine et al. | 342/153 |
| 3,731,235 | A | 5/1973 | Ditullio et al. | |
| 3,918,064 | A | 11/1975 | Gustincic | |
| 4,122,446 | A | 10/1978 | Hansen | |
| 4,222,017 | A | 9/1980 | Foldes | |
| 4,847,574 | A | 7/1989 | Gauthier et al. | |
| 5,373,302 | A | 12/1994 | Wu | |
| 5,684,495 | A * | 11/1997 | Dyott et al. | 343/785 |
| 5,835,057 | A | 11/1998 | Van Heyningen | |
| 6,052,099 | A * | 4/2000 | Imaizumi et al. | 343/840 |
| 6,329,957 | B1 | 12/2001 | Shea et al. | |
| 6,566,976 | B2 | 5/2003 | Krishmar-Junker et al. | |
| 6,593,893 | B2 | 7/2003 | Hou et al. | |
| 6,714,165 | B2 | 3/2004 | Verstraeten | |
| 6,861,998 | B2 * | 3/2005 | Louzir et al. | 343/781 P |
| 7,102,585 | B2 | 9/2006 | Hsiu et al. | |
| 7,129,903 | B2 * | 10/2006 | Desargant et al. | 343/781 CA |
| 7,224,320 | B2 | 5/2007 | Cook | |
| 7,443,355 | B2 | 10/2008 | Griffiths | |
| 8,120,541 | B2 * | 2/2012 | Jung et al. | 343/766 |
| 8,866,564 | B2 | 10/2014 | Monte et al. | |
| 2003/0184486 | A1 | 10/2003 | Shafai et al. | |
| 2005/0046511 | A1 | 3/2005 | Stenberg | |
| 2007/0080887 | A1 * | 4/2007 | Ho | 343/840 |
| 2007/0089142 | A1 * | 4/2007 | Norin et al. | 725/63 |
| 2011/0181479 | A1 | 7/2011 | Martin et al. | |
| 2013/0201070 | A1 | 8/2013 | Parschc | |
| 2013/0342390 | A1 | 12/2013 | Cha et al. | |
| 2014/0057576 | A1 | 2/2014 | Monte et al. | |

FOREIGN PATENT DOCUMENTS

| | | | |
|---|---|---|---|
| GB | 2194859 | A | 3/1988 |
| KR | 101172437 | B1 | 8/2012 |
| WO | WO 2010/076336 | A1 | 7/2010 |
| WO | WO 2011/099672 | A1 | 8/2011 |
| WO | WO 2014/035824 | A1 | 3/2014 |

OTHER PUBLICATIONS

Beadle, M. et al., "A C/X/Ku-band Dual Polarized Cassegrain Antenna System," *IEEE*, 692-695 (1999).

Cavalier, M. and Shea D., "Antenna System for Multi-Band Satellite Communications," *IEEE*, 5 pages (1997).

Cavalier, M., "Feed for Simultaneous X-Band and KA-Band Operations on Large Aperture Antennas," *IEEE*, 5 pages (2007).

Cavalier, M., "Marine Stabilized Multiband Satellite Terminal," *IEEE*, 1-3 (2002).

International Search Report and Written Opinion, issued in International Application No. PCT/US2013/056411, "Antenna System with Integrated Distributed Transceivers", Date of Mailing: Jan. 31, 2014.

Invitation to Pay Additional Fees and, Where Applicable, Protest Fees, issued in International Application No. PCT/US2013/056411, "Antenna System with Integrated Distributed Transceivers", Date of Mailing: Dec. 3, 2013.

International Preliminary Report on Patentability, issued in International Application No. PCT/US2013/056411, "Antenna System with Integrated Distributed Transceivers," Date of Mailing: Mar. 12, 2015.

Collins, G.W., "Shaping of Subreflectors in Cassegrainian Antennas for Maximum Aperture Efficiency", IEEE Transaction of Antennas and Propagation, 21:3, May 1973.

Arntdt, F., et al. "Conical Circular Waveguide with Side-Coupled Rectangular Ports Analyzed by a Hybrid Mode-Matching Method of Moment Technique", Microwave Conference, 2005, European, vol. 2, No., p. 4, pp. 4-6, Oct. 2005.

Uher, J., et al. "Waveguide Components for Antenna Feed Systems: Theory and CAD", Artch House Antennas and Propagation Library, 1993, pp. 413-418, Combiner Design Type 3 (Symmetrical Branching Approach).

* cited by examiner

MULTI-BAND ANTENNA SYSTEM FOR SATELLITE COMMUNICATIONS

CROSS REFERENCES

This patent application claims the benefit of U.S. Provisional Application Ser. No. 61/244,260 filed Sep. 21, 2009, the contents of which are incorporated by reference herein.

FIELD OF THE INVENTION

The present invention is generally related to the field of satellite communications and antenna systems, and is more specifically directed to multi-band antenna systems that allow simultaneous reception of RF energy from multiple satellites positioned in several orbital slots broadcasting at multiple frequencies.

BACKGROUND OF THE INVENTION

An increasing number of applications are requiring systems that employ a single antenna designed to receive RF energy from multiple satellites positioned in several orbital slots broadcasting at multiple frequencies. In cases where the satellites are very close to each other, it creates a challenge for reflector antenna systems often resulting in compromised performance and/or increased cost and complexity. On a given reflector system a feed (horn or radiating element) is needed to receive signals from each satellite.

A typical mobile satellite antenna has a stationary base and a satellite-following rotatable assembly mounted on the base for two- or three-axis rotation with respect to the base. The assembly includes a primary reflector, a secondary shaped sub-reflector, and a low-noise block down-converter. It may also include gyroscopes for providing sensor inputs to the rotatable assembly's orientation-control system. A typical configuration of this satellite antenna mounting approach is disclosed in U.S. Pat. No. 7,443,355.

U.S. Pat. No. 5,835,057 discloses a mobile satellite communication system including a dual-frequency antenna assembly. This system is configured to allow for the Ku band signals containing video and image data to be received by the antenna device and the L band signals containing voice/facsimile to be both received and transmitted by the antenna device on a moving vehicle.

U.S. Pat. No. 7,224,320 discloses an antenna device capable of reception from (and/or transmission to) at least three satellites of three separate RF signals utilizing a basic offset reflector on a stationary platform. This device allows for digital broadcast signals from digital video broadcast satellites in Ka, Ku and Ka frequency bands on the stationary platform.

U.S. Pat. No. 5,373,302 discloses an antenna device capable of transmission of three or more separate RF signals using a primary reflector and a frequency selective surface sub-reflector on a stationary platform. However, the patent fails to disclose the antenna device on a moving platform and also fails to disclose any time of movement of the reflector including its components to track separate frequency signals.

U.S. Pat. No. 6,593,893 discloses a multiple-beam antenna system employing dielectric filled feeds for multiple and closely spaced satellites. However, in this system, the two satellites disclosed are stationary above the earth's equatorial plane and are restricted to be spaced two degrees of arc apart in their geostationary positions. Further, the patent also fails to disclose providing the antenna system on a moving platform with a skew mechanism to simultaneously align the multiple beams with the corresponding multiple satellites across the geostationary orbital arc.

Thus there is a need to provide an improved antenna system that allows for simultaneous reception of at least two different satellite signals, e.g., high definition television (HDTV) signals in Ku and Ka frequency bands on a moving platform.

OBJECTS AND SUMMARY OF THE INVENTION

One of the objectives of the present invention is to design an antenna that is capable of simultaneously receiving at least two separate RF signals with orthogonal, linear or circular polarization. This is accomplished by providing a mobile antenna system in communication with multiple satellites for use on a moving platform. The system includes a primary reflector shaped and positioned to receive and reflect band signals of different angles to a focal region located in front of the primary reflector. Preferably, the band signals include Ku and Ka band signals. The primary reflector includes at least one opening or other attachment for accommodating a feed assembly to receive the band signals and a sub-reflector shaped and positioned between the primary reflector and the focal region to receive and reflect the band signals that the primary reflector directed to the focal region. The system further includes a motor driven mechanism positioned around the feed assembly that functions to align the angle of the feed assembly with the angle of the geostationary orbital arc.

In one embodiment, the present invention is directed to an antenna system as described above, wherein the feed assembly includes two or three metal feed horns to track two or three different band signals, respectively. Most preferably, the feed horns are adapted to receive Ka and Ku band signals.

In other embodiment, the present invention is directed to an antenna system as described above in which the feed assembly includes two or three dielectric rod feeds to track two or three different band signals, respectively. Most preferably, the dielectric rod feeds are adapted to receive Ka and Ku band signals.

In alternate embodiments, the present invention is directed to an antenna system as described above in which the feed assembly contains a combination of feed horns and dielectric rod feeds to track two or three different band signals, respectively. Most preferably, the combination is adapted to receive Ka and Ku band signals.

As will be apparent from the description provided herein, the systems of the present invention are not only capable of simultaneously tracking signals from different satellites, but are also advantageously compact in size to allow for better mobility of the system itself.

BRIEF DESCRIPTION OF THE DRAWINGS

The present invention will be more readily understood from the detailed description of exemplary embodiments presented below considered in conjunction with the attached drawings, of which.

DETAILED DESCRIPTION OF THE INVENTION

Figure 1:
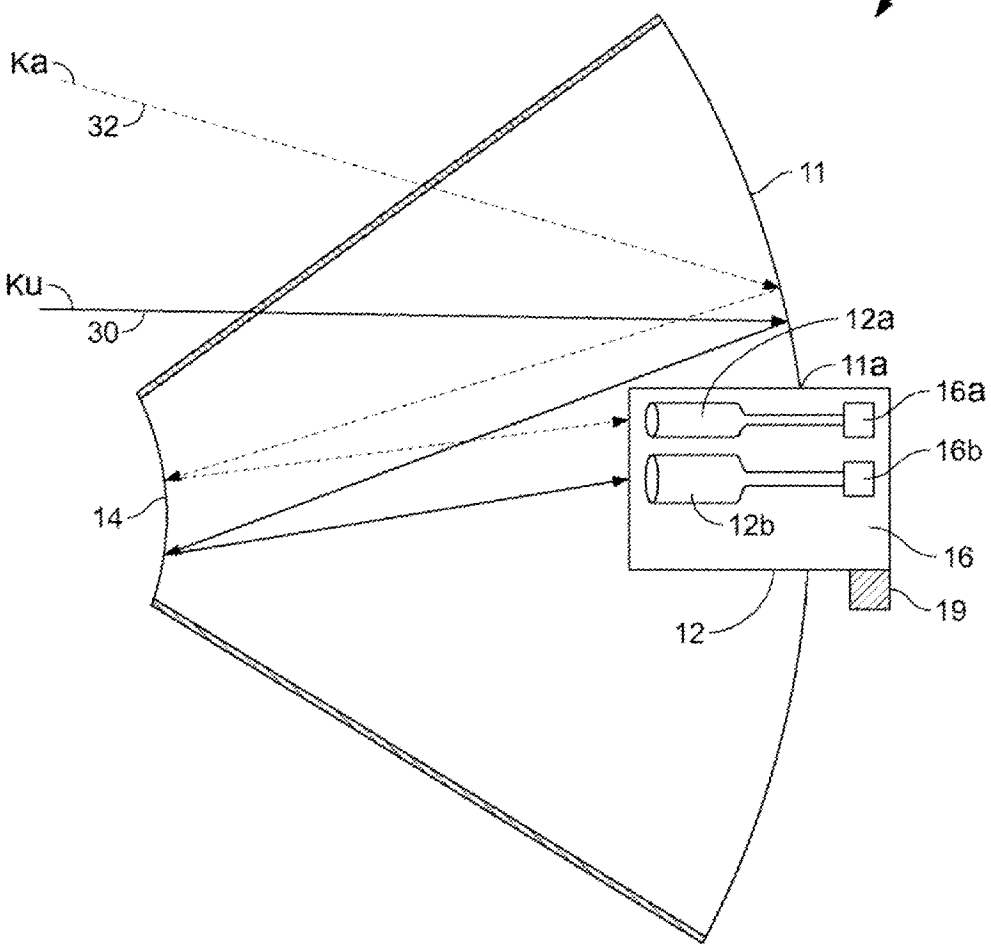
FIG. 1 depicts a schematic drawing of one embodiment of the antenna system of the present invention.

FIG. 1 illustrates a schematic view of a preferred embodiment of the satellite-antenna system 10 installed on a roof of a moving platform (not shown) configured to receive at least three separate RF signals in accordance with an embodiment of the present invention. The antenna system 10 is preferably an axially symmetrical reflector system. The system 10 includes a primary reflector 11, having at least one opening 11*a*. The reflector shown in the present embodiment is a parabola-shaped reflector and is preferably made of metals such as aluminum or steel, however the other construction materials may be used, such as carbon fiber. The system 10 further includes a feed horn assembly 12 having at least two feed tubes/horns 12*a*, and 12*b* extending from the front to the rear of the primary reflector 11 via the opening 11*a*. As an example shown in FIG. 1, the feed horn 12*a* is configured to receive Ka signal 30 and the feed horn 12*b* is configured to receive a Ku signal 32. Feed horns 12*a* and 12*b* are preferably made of metals such as aluminum or steel, although they may also be metal coated plastic. The feed horns 12*a* and 12*b* may vary in shape and size. As illustrated in FIG. 1, the primary reflector 11 is coaxially disposed about the feed assembly 12. A low-noise block (LNB) converter assembly 16 is affixed to one end of the feed horn assembly 12 at the rear of the primary reflector as shown. Specifically, the LNB converter 16*a*, preferably a Ka Band LNB is affixed to one end of the feed horn 12*a* at the rear of the primary reflector as shown. Similarly, a LNB converter 16*b*, preferably a Ku Band LNB is affixed to one end of the feed horn 12*b* at the rear of the primary reflector as shown in FIG. 1.

The system 10 further includes at least a sub-reflector 14, disposed to face towards the front of the primary reflector 11. Specifically, the front surface of the sub-reflector 14 includes a reflecting surface facing the front surface of the primary reflector 11. The sub-reflector is a solid construction, and does not contain any openings, unlike the primary reflector. In order for the sub-reflector 14 to be in-plane and concentric with the primary reflector 11, specific range of distance and/or angle are chosen such that the sub-reflector 14 images the satellite beam reflected from the surface of the primary reflector 11 onto the end of the feed horn assembly 12. This range of distance and/or angle preferably depends on the shape and the size of both the primary and the sub-reflector. The sub-reflector 14 shares the same axis as the primary reflector 11 and the feed horns 12*a* and 12*b*. As a result, the sub-reflector 14 is positioned to receive RF signals between the feed horns 12*a* and 12*b* and the primary reflector 11. Because of the presence of the double feed horn arrangement of the feed assembly 12 in the primary reflector 11, the shape of the sub-reflector 14 can be varied from the typical hyperbolic shape normally found in Cassegrain antennas. A modified hyperbolic shape of the sub-reflector 14 allows for larger separation between the feed horns 12*a* and 12*b* in the feed horn assembly 12. The sub-reflector is made of RF reflecting material such as, e.g., aluminum or steel. The sub reflector 14 is secured to the main-reflector 11 preferably via support brackets (not shown). Alternative methods to secure the sub reflector 14 use a dielectric cone support or a dielectric low density foam support to attach directly to the feed horn assembly 12. A mechanical actuator 19 is connected to the assembly 12 to rotate the feed horns as will be described in greater detail below with respect to FIGS. 2 and 3.

Figure 1A:
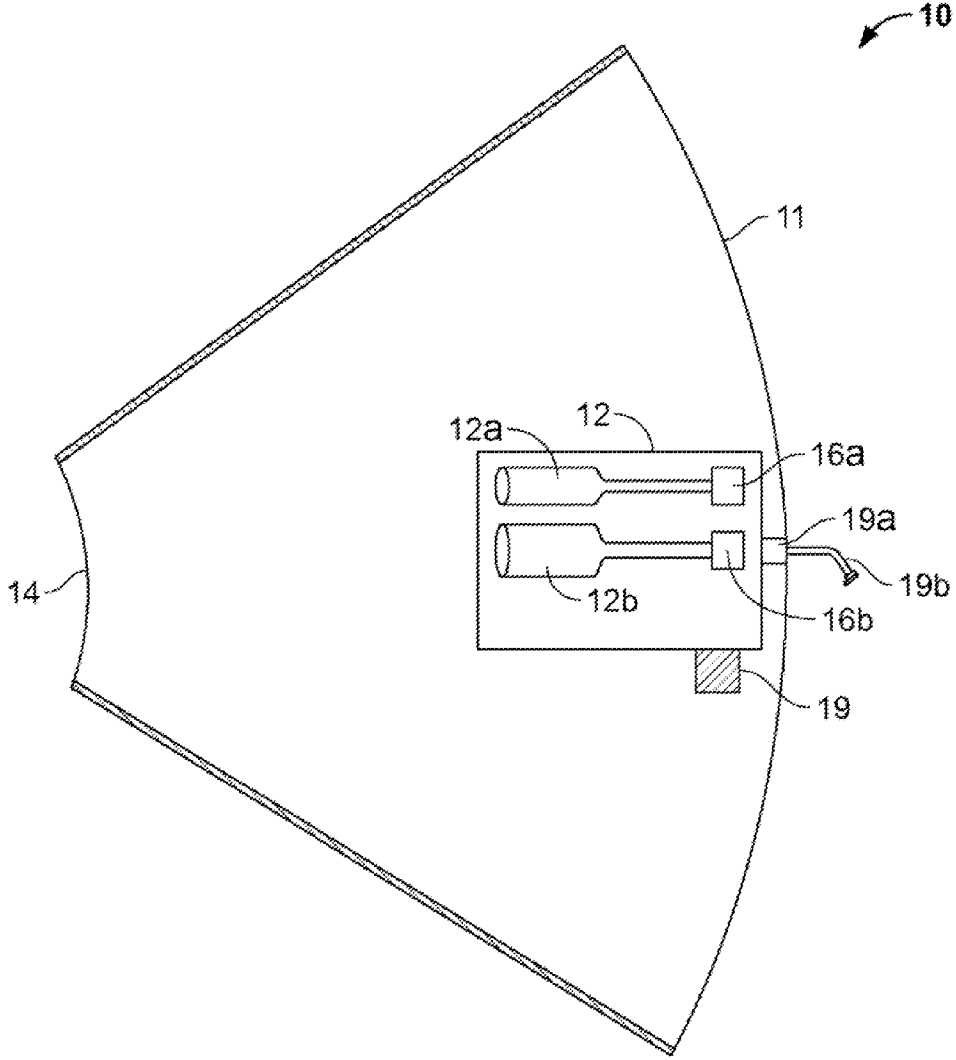
FIG. 1A depicts a schematic drawing of another embodiment of the antenna system of the present invention.

FIG. 1A illustrates a similar embodiment to that depicted in FIG. 1; however the feed horn assembly 12 is positioned in front of the primary reflector 11. Thus, the primary reflector 11 as shown in FIG. 1A does not include any opening. Instead a coaxial rotary joint 19*a* attaches the feed horn assembly 12 to the primary reflector 11. A coaxial cable output 19*b* may then be affixed to the coaxial rotary joint 19*a*.

Figure 1B:
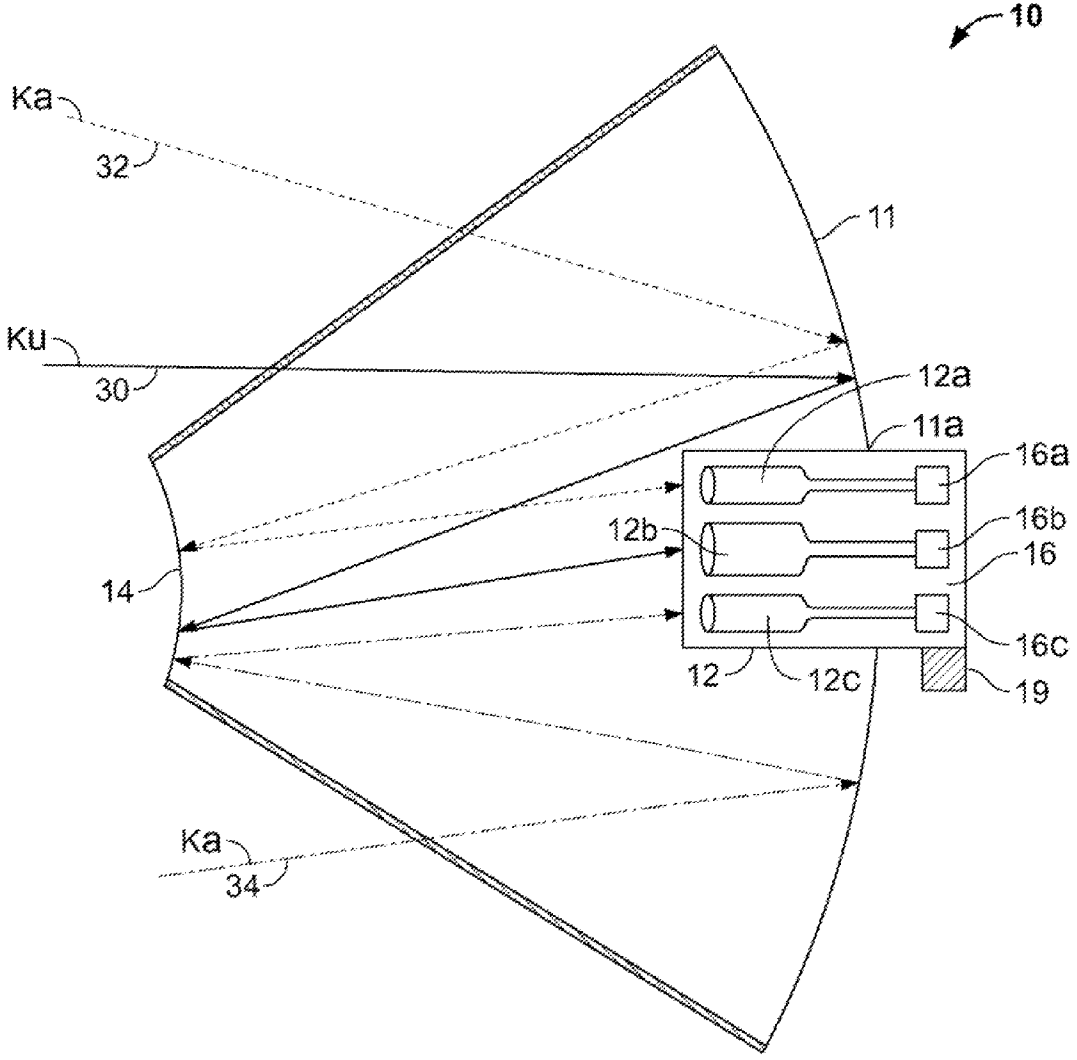
FIG. 1B depicts a schematic drawing of an alternate embodiment of the antenna system of the present invention.

In alternate embodiments, as shown in FIG. 1B, the antenna as described in FIG. 1 above, with an additional feed horn 12*c* in the feed horn assembly configured to receive a Ka band signal 34. Also, an additional LNB converter 12*c*, preferably a Ka Band LNB is affixed to one end to the feed horn 12*c* at the rear of the primary reflector 11. In such embodiments, the three feed horns are capable of receiving signals from three different satellites as will be described in greater detail below.

The feed horns of the present invention are designed to provide symmetrical radiation patterns at different bands, while advantageously maintaining a compact outer diameter. This pattern symmetry provides higher efficiency and improved off axis performance. The feed horns incorporate a smooth outer wall and use the combination of two modes, the dominate Transverse Electric mode ($TE_{11}$) and one higher order mode, the Transverse Magnetic mode ($TM_{11}$), to provide a radiation pattern similar to a larger outer diameter corrugated horn counterpart. The detailed operation of these horns is described in U.S. Pat. Nos. 3,305,870 and 4,122,446, hereby incorporated by reference. Preferably, the diameter of each of the feed horns of the present invention is in the range of about 0.9" to 1.0". One of the advantages of using these smaller diameter horns is that the feed horns can be placed side by side (approximately 0.45" to 0.50" apart). In embodiments comprising three feed horns which track, e.g., Ka/Ku/Ka band signals, the side-by-side placement of the feed horns with the correct linear offset from the center of the primary reflector axis to provide the +/−2 degree angular offsets from the center Ku-band beam. This also allows for larger separation of the Ka-band feed horns with the Ku-band feed horn being placed in the middle, thus allowing for a more compact design.

In certain embodiments, the feed horns are constructed from a conductive metal material, preferably as a single cast or as described in U.S. Pat. No. 7,102,585, hereby incorporated by reference. This type of construction allows for placement of the feed horns in close proximity to each other, thereby providing a more efficient compact design.

Figure 2:
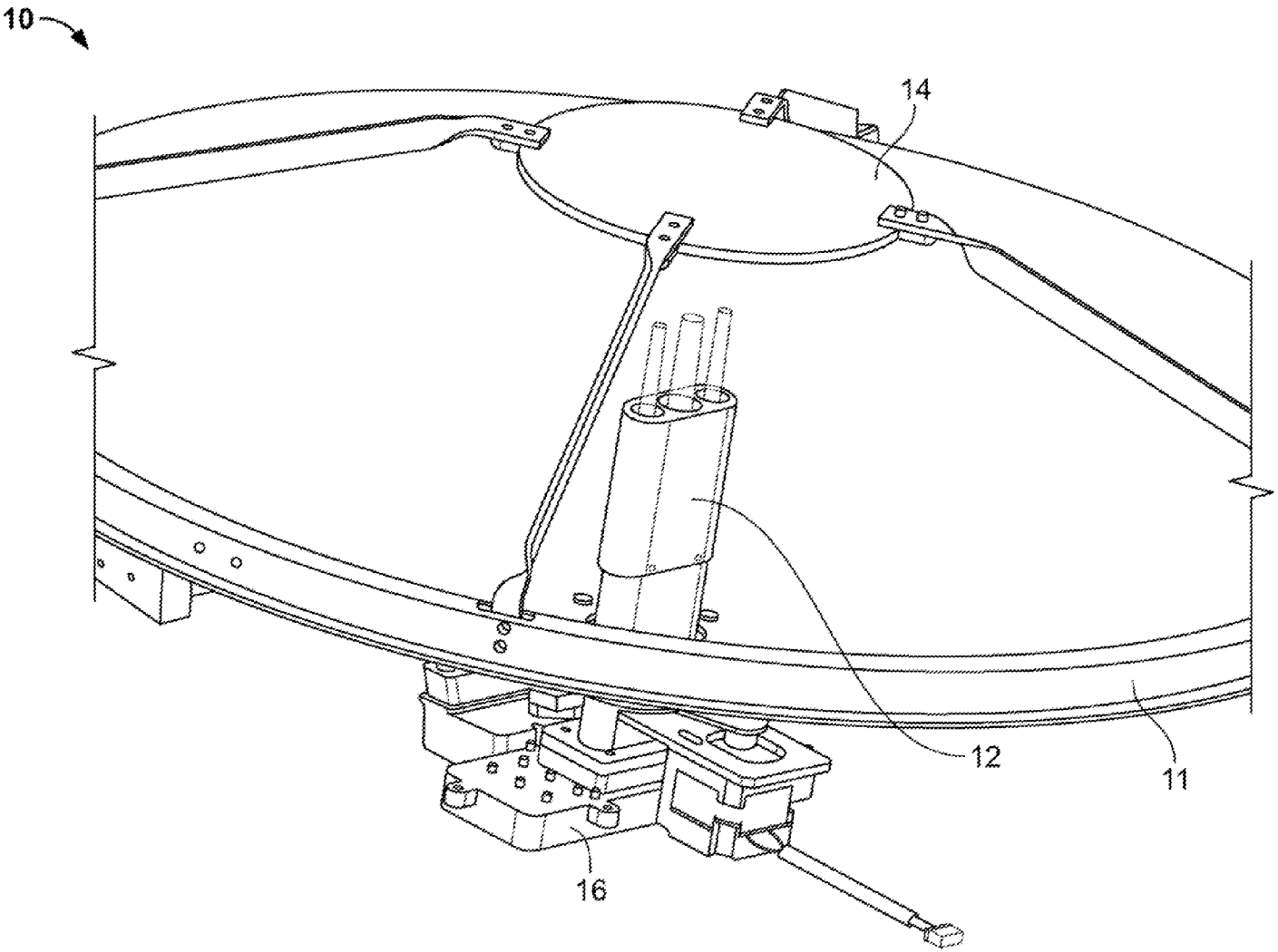
FIG. 2 depicts a top view of the antenna system of the present invention.
Figure 3:
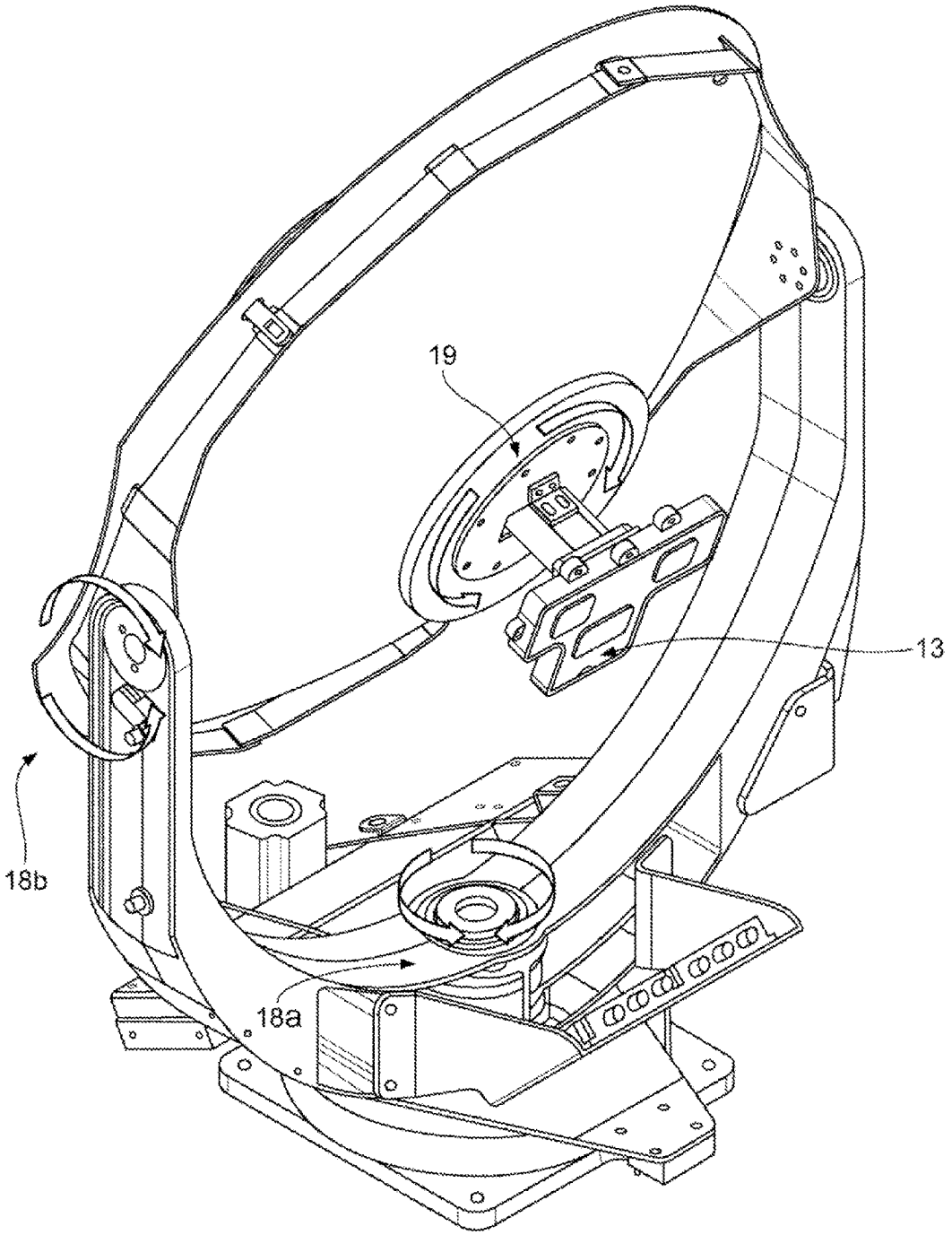
FIG. 3 depicts a back view of the antenna system of the present invention.

Referring to FIGS. 2 and 3, there is shown a top and back view of an embodiment of the antenna system 10 of FIG. 1B, respectively. The system 10 also includes an azimuth adjustment assembly 18*a* to rotate the system 360° and an elevation adjustment assembly 18*b* to rotate the system from 10-85°, which are motor driven mechanisms used generally for single beam antenna. Additional details of these mechanisms for a single beam antenna are provided in the U.S. Pat. No. 5,835,057, which is hereby incorporated by reference. However, in the present invention, the antenna system 10 is tracking beams from two or preferably at least three different satellites (not shown) at various angles. Thus, a third axis of mechanical motion is required to simultaneously align the antenna beams with the geostationary orbital arc, despite the relative motion of the moving platform. This third axis of mechanical motion is provided by a skew adjustment 19 which is also a motor driven mechanism placed behind the primary reflector 11 encompassing a portion of the feed horns 12*a*, 12*b* and 12*c* as shown in FIG. 3. This skew adjustment 19 functions to rotate the feed horns 12*a*, 12*b* and 12*c* about the center axis of the primary reflector 11 to align with the orbital arc in order to track, e.g., the Ku and Ka band beams from three different satellites (not shown) at different angles. Therefore, this satellite-antenna system 10 will simultaneously adjust the azimuth and elevation of the complete Ka/Ku/Ka multi-beam antenna and rotation angle of the Ka-Ku-Ka-band feed horn assembly 12 to keep all the three beams simultaneously pointed towards the desired satellites. Note that FIG. 3 depicts three feed horns, however the skilled artisan will appreciated that a feed horn assembly containing two feed horns as described above (not shown) would function in a similar manner.

In alternate embodiments (not shown), a fourth axis is added to further adjust the mechanical motion. The fourth axis is provided by a cross-elevation adjustment assembly to allow for a rotation of 0-90°.

More particularly, in embodiments comprising a three-feed horn system to track Ka/Ku/Ka band signals, a first satellite (not shown) located preferably at 101 degrees west longitude delivers a beam 30 in a Ku frequency band of 11 GHz to 13 GHz to the primary reflector 11.

The active surface of the primary reflector 11 reflects this beam signal 30 to the sub-reflector 14. The reflecting surface of sub-reflector 14 in turn reflects the beam signal 30 directly into the feed horn assembly 12. A circular waveguide transition (not shown) routes the beam signal 30 between the common band feed horn interface (not shown) and the LNB 16 with a circular waveguide interface. The circular waveguide transition is designed to provide a low reflection path between the partially dielectric loaded circular waveguide and the standard circular waveguide (without partial dielectric loading). The LNB 16*b* amplifies and down converts to a lower frequency band.

A second satellite (not shown) positioned preferably at 99 degrees west longitude delivers a beam 32 in a Ka frequency band of 18 GHz to 20 GHz. The active surface of the primary reflector 11 reflects this beam signal 32 to the sub-reflector 14. The reflecting surface of the sub-reflector 14 in turn reflects the beam 32 to the feed assembly 12. The LNB 16*a* amplifies and down converts to a lower frequency band.

A third satellite (not shown) located preferably at 103 degrees west delivers a beam 34 similar to the beam 32 such that it also contains Ka frequency of 18 GHz to 20 GHz. The active surface of the primary reflector 11 reflects this beam signal 34 to the sub-reflector 14. The reflecting surface of the sub-reflector 14 in turn reflects the beam 32 to the feed assembly 12. The feed assembly 12 guides this beam signal 34 directly into the LNB 16*c*, as described above, which amplifies and down converts to a lower frequency band.

The LNBs 16*a*, 16*b* and 16*c* are located within the LNB assembly 16 and down convert the Ka and Ku to L Band frequency. Specifically, the Ka LNBs 16*a* and 16*c* convert down to 250-750 MHz and 1650-2150 MHz and the Ku LNB 16*b* converts down to 950-1450 MHz. In a preferred embodiment, these L Band signals can be fed into a splitter/combiner (not shown) which will pass the combined or stacked signal to a receiver (not shown). The receiver in turn unstacks the L Band signal so that the user can watch digital video broadcasts. In embodiments with only two feed horns, the LNB assembly comprises two LNBs to convert the appropriate signals.

In other embodiments of the present invention, a set of dielectric rod feed horns is used in place of the feed horns 12*a*, 12*b* and 12*c* of the feed horn assembly 12 as described above. Dielectric rod feed horns can offer improved overall performance of the antennae system. Each dielectric rod feed horn operates by efficiently launching the hybrid $TE_{11}$ mode on the dielectric rod waveguide. The $TE_{11}$ mode is the mode in the fully loaded circular waveguide. In the presence of partial circular dielectric loading in the circular waveguide, the mode becomes the $HE_{11}$ mode. In certain embodiments, a dielectric rod waveguide without a metal shield supports the $HE_{11}$ mode. Each metal horn transition is designed to minimize radiation from the fully dielectric loaded metal waveguide to dielectric rod waveguide and efficiently convert the $TE_{11}$ mode to the $HE_{11}$ mode. In this way a majority of the radiation emanates from the end of the dielectric rod waveguide. The metal launcher can be truncated at a smaller diameter and allow for a closer packing of the feed horns.

Dielectric rod feed horns provide symmetrical radiation patterns, which lead to improved antenna efficiency and lower off axis cross polarization levels, as well as a compact feed geometry, which leads to compact reflector antennas with multiple beams. For example, in such an arrangement, the feed horn center to feed horn center spacing is about 0.625".

Figure 4:
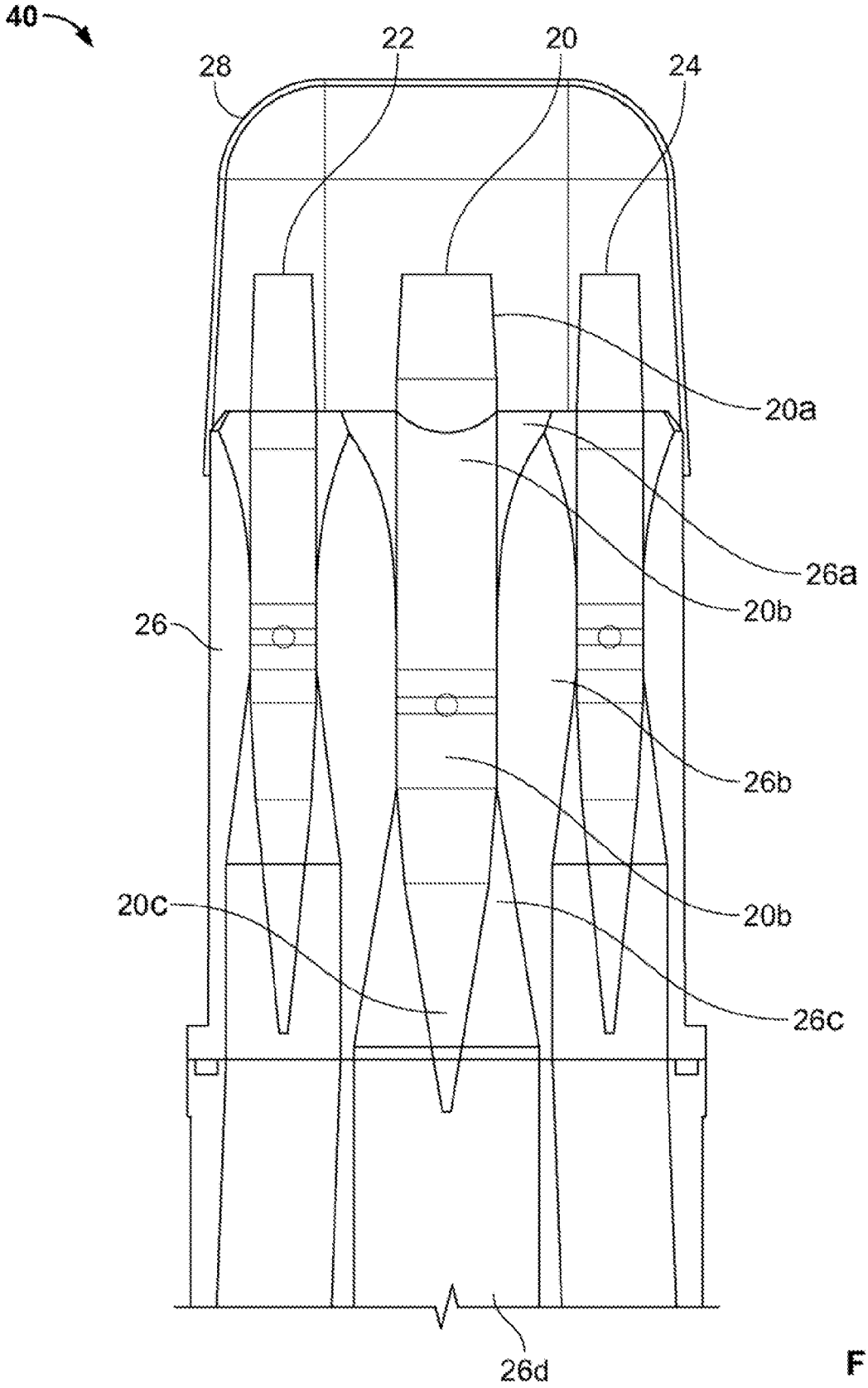
FIG. 4 depicts a schematic drawing of a dielectric rod feed horn assembly for the antenna system in accordance with another embodiment of the present invention.

An example of a three-rod dielectric feed horn assembly 40 for the antenna system 10 is shown in FIG. 4. The dielectric feed horn assembly 40 consists of three dielectric rod waveguide radiators 20, 22 and 24, a metal or metalized plastic feed horn body 26, and a thin dielectric feed horn window 28. Dielectric rod 20 is designed to receive Ku-band across the 11.45 to 12.7 GHz range. Dielectric rods 22 and 24 are designed to receive signals across Ka-band, 18.3 to 20.2 GHz.

As known in the art, each dielectric rod feed horn preferably consists of five sections; a circular waveguide interface, a waveguide matching section, a dielectric rod support section, a metal flare transition section and a dielectric rod section. For example, as illustrated in FIG. 4, the respective sections for the center Ku-band dielectric rod feed 20 comprise of 20*a* for the dielectric rod section, 20*b* and 26*a* for the transition section, 20*b* and 26*b* for the dielectric rod support section, 20*c* and 26*c* for the waveguide matching section, and 26*d* for the circular waveguide interface.

The matching section of each of the dielectric rod feed horn includes tapered transitions between the fully dielectric loaded and the unloaded circular waveguide sections. As an example, in the Ka-band feed matching section 20*c* and 26*c* of FIG. 4, the unloaded circular waveguide diameter can be about 0.4407 and the fully loaded dielectric waveguide diameter can be about 0.250". The dielectric material can be, for example, a cross linked polystyrene with a dielectric constant of about 2.54. As the dielectric tapers from a small diameter to the larger diameter the metal wall tapers from the large diameter to the smaller diameter. The dimensions of the tapers are designed for low signal reflection levels.

The support section of each of the dielectric rod feed horn preferably consists of a short length of straight circular waveguide which is completely filled with the dielectric material. The purpose of this straight section is to provide a concentric support of the dielectric rod waveguide.

The metal flare section of each of the dielectric rod feed horn provides a transition between the fully loaded circular waveguide to the dielectric rod waveguide without a metal wall. The shape of the metal transition is designed to prevent radiation and to launch the $HE_{11}$ mode onto the rod efficiently. The smooth metal transition offers a gradual transition and thereby minimizes radiation at the waveguide transition and minimizes the refection levels. The dielectric rod diameter is essentially held constant in this section. The largest diameter of the metal horn transition at Ka-band is, for example, approximately 0.570".

The dielectric rod section consists of a straight or slightly tapered dielectric rod. For example, the dielectric rod diameter starts at about 0.250" and tapers to about 0.235" with a gradual taper. The $V_o$ value is the normalized waveguide parameter of a dielectric rod waveguide. $V_o$ is defined by the dielectric constants of the rod and the surrounding medium, the rod radius, a, and the free space operating wavelength. In this case the dielectric constant of the rod $\in_2$ is 2.54 and the surrounding medium is air with the dielectric constant $\in_1=1$.

The $V_o$ is defined as $V_o=k_o a\sqrt{\in_2-\in_1}$, where $$k_0 = \frac{2\pi}{\lambda_o}$$

and $\lambda_o$ is the free space wavelength at 19.25 GHz.

The $V_o$ is 1.59 at center Ka-band frequency. This $V_o$ is large enough to support the dominate $HE_{11}$ mode and capture the signal onto the dielectric rod. However, the $V_o$ is not too large to allow higher order modes to propagate. The first higher order mode cutoff is at $V_o=2.4$. Across the Ka-band the $V_o$ value range is preferably from 1.51 to 1.66. At Ku-band, the V-value ranges preferably from 1.6 to 1.91 for the HD11 design. It is noted that if the value of $V_o$ is below 1.4, the wave is not tightly bound to the dielectric rod and the energy is not trapped by the dielectric rod. It is further noted that if the value of $V_o$ is above 2.4, the dielectric rod can support a higher order mode, which could degrade the symmetrical radiation pattern. Therefore, a useful working range for the V-value is preferably from 1.4 to 2.0.

Dielectric waveguide transitions including the smooth wall metal horn for launching a pure HE11 mode onto a dielectric rod is further detailed in U.S. Pat. No. 5,684,495, incorporated herein by reference.

Figure 5:
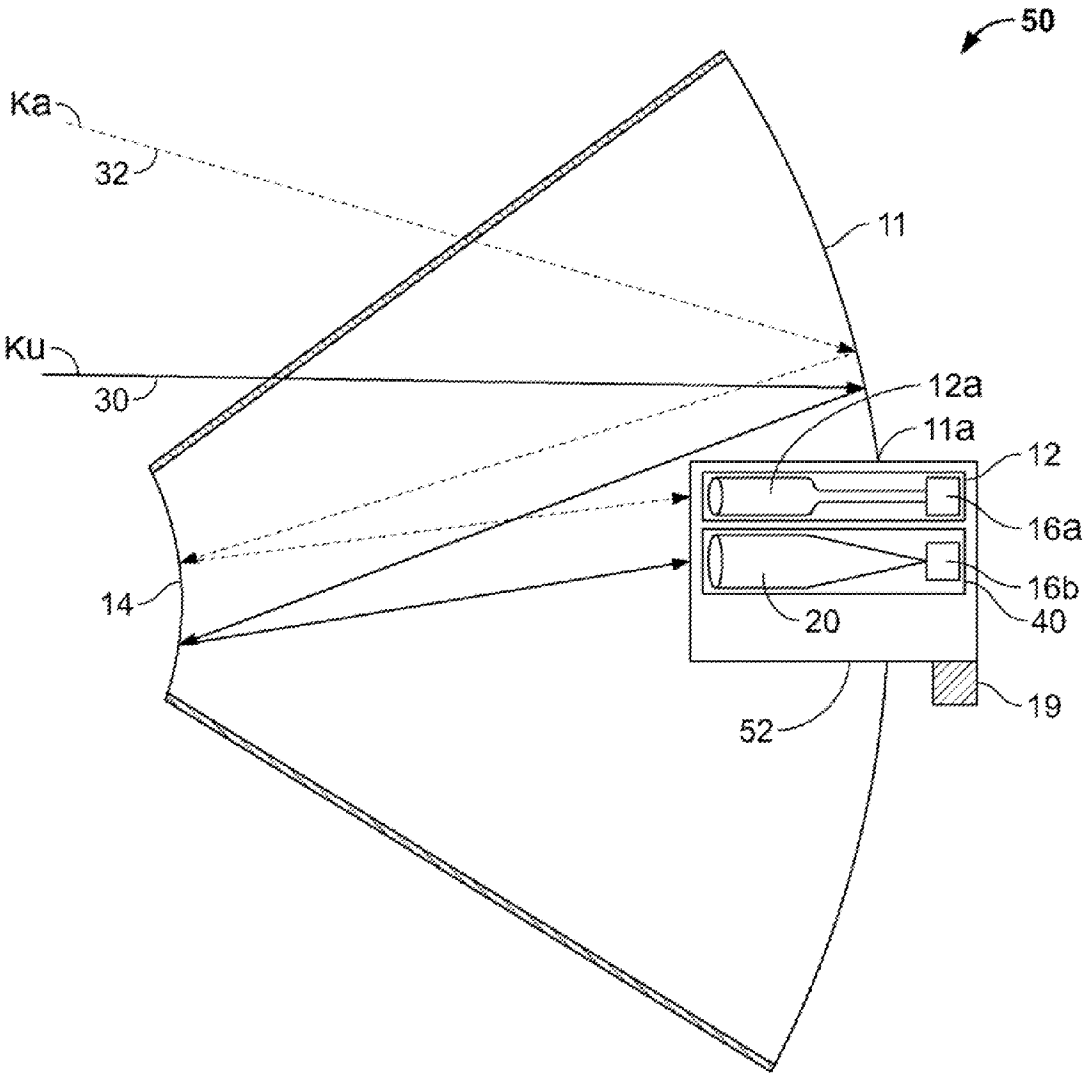
FIG. 5 depicts a schematic drawing of a further embodiment of the antenna system of the present invention.

In a further embodiment of the present invention as shown in FIG. 5, a satellite antenna system 50 includes a feed assembly 52 including a combination of feed horn assembly 12 as described in FIG. 1 and dielectric feed horn assembly 40 as described in FIG. 2. In other words, the feed horn assembly may include a combinations of one of a metal feed horn 12*a*, 12*b* or 12*c* and one of a dielectric rod feeds 20, 22 and 24. As an example of this combination is illustrated in FIG. 5 in which the feed horn assembly 52 includes one metal feed horn 12*a* for the Ka-band feeds and a single dielectric rod feed 20 in the center for Ku-band feeds.

In certain embodiments, the dielectric rod feeds may be surrounded by low density foam to prevent water ingress in the transition regions and on the dielectric rod radiators.

In other embodiments, the metal launcher may be constructed from three separate metal horns or as one piece.

In a preferred embodiment of the present invention, the main reflector diameter is approximately 24" with an 8" focal length. The metal sub reflector is a shaped sub reflector which is modified from the classical dual reflector Cassegrain design for improved antenna efficiency. An example of a sub reflector shaping technique is can be found in Collins, G. W., "Shaping of Subreflectors in Cassegrainian Antennas for Maximum Aperture Efficiency", *IEEE Transactions on Antennas and Propagation*, Vol. AP-21, No. 3, May 1973, incorporated herein by reference.

It is noted that the above described embodiments of the present invention can be used in conjunction with the mounting arrangement of the antenna assembly on a moving platform as disclosed in commonly owned issued U.S. Pat. No. 7,443,355, which is hereby incorporated by reference.

As discussed above, the shape and the position of the primary reflector, sub-reflector and feed horns are mechanically determined to provide a focus of the satellites into the feed assembly, while the skew adjustment works to place the appropriate feed horn into the focal position, displacing the other feed horn(s). The displacement can be to any of the following frequency band combinations: Ka/Ku/Ka; Ka/Ka/Ka; Ka/Ka; Ka/Ku; Ka/Ka/Ku; Ka/Ku/Ku or Ku/Ku. While the vehicle is in motion, a satellite tracking system, such as disclosed in commonly owned issued U.S. Pat. No. 5,835,057 can be employed to maintain focus such that all the signals go directly into their respective feed horns.

While the present invention has been described with respect to what are some embodiments of the invention, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. A mobile antenna system in communication with multiple satellites for use with a moving platform, the system comprising:

a primary reflector coupled to an azimuth adjustment motor and an elevation adjustment motor, the primary reflector positioned to reflect at least one Ku band signal and at least one Ka band signal to a focal region of the primary reflector;

a feed horn assembly rotatably and mechanically coupled to the primary reflector, said feed horn assembly comprising at least two feed horns such that said first feed horn receives the at least one Ku band signal and the second feed horn receives the at least one Ka band signal;

a sub-reflector positioned to face the focal region of the primary reflector to reflect the at least one Ku band signal and the at least one Ka band signal directed by the focal region of the primary reflector;

a motor driven mechanism to rotate an orientation of the feed horn assembly mechanically relative to the primary reflector, the rotation of the feed horn assembly being (i) substantially about a center axis of the primary reflector, and (ii) arranged to actively maintain alignment of one or more antenna beams associated with the Ku and Ka band signals with a geostationary orbital arc, the alignment being actively maintained relative to the moving platform; and a tracking controller configured to provide a motor control signal to the motor driven mechanism, the tracking controller configured to generate the motor control signal based on one or more attitude sensors associated with the moving platform and based on the received Ku band signal and the received Ka band signal, the tracking controller further configured to coordinate the motor control signal with one or more of an azimuth control signal configured to control the azimuth adjustment motor and an elevation control signal configured to control the elevation adjustment motor.

2. The system of claim 1, further comprising at least one low noise block converter assembly affixed to the feed horn assembly for converting frequency of the Ka and Ku band signals to L band frequency.

3. The system of claim 1, wherein the system is capable of being mounted on a moveable platform.

4. The system of claim 1, wherein said at least two feed horns comprise metal horns.

5. The system of claim 1, wherein said at least two feed horns comprise dielectric rod feeds.

6. The system of claim 5, wherein normalized waveguide value of the dielectric rod feed is in the range of 1.4 to 2.0.

7. The system of claim 5, wherein normalized waveguide value of the dielectric rod feed with the Ka band is in the range of 1.51 to 1.66.

8. The system of claim 5, wherein normalized waveguide value of the dielectric rod feed with the Ku band is in the range of 1.6 to 1.91.

9. The system of claim 1, wherein said at least two feed horns comprise a combination of at least one metal horn and at least one dielectric rod feed.

10. A mobile antenna system in communication with multiple satellites for use with a moving platform, the system comprising:

a primary reflector coupled to an azimuth adjustment motor and an elevation adjustment motor, the primary reflector positioned to reflect at least two Ka band signals to a focal region of the primary reflector;

a feed horn assembly rotatably and mechanically coupled to the primary reflector, said feed horn assembly comprising at least two feed horns to receive the at least two Ka band signals;

a sub-reflector positioned to face the focal region of the primary reflector to reflect the at least two Ka band signals directed by the focal region of the primary reflector;

a motor driven mechanism configured to rotate an orientation of the feed horn assembly mechanically relative to the primary reflector, the rotation of the feed horn assembly being (i) substantially about a center axis of the primary reflector, and (ii) arranged to actively maintain alignment of one or more antenna beams associated with the Ku and Ka band signals with a geostationary orbital arc, the alignment being actively maintained relative to the moving platform; and a tracking controller configured to provide a motor control signal to the motor driven mechanism, the tracking controller configured to generate the motor control signal based on one or more attitude sensors associated with the moving platform and based on the received Ku band signal and the received Ka band signal, the tracking controller further configured to coordinate the motor control signal with one or more of an azimuth control signal configured to control the azimuth adjustment motor and an elevation control signal configured to control the elevation adjustment motor.

11. The system of claim 10, wherein the system is capable of being mounted on a moveable platform.

12. The system of claim 10, wherein said at least two feed horns comprise metal horns.

13. The system of claim 10, wherein said at least two feed horns comprise dielectric rod feeds.

14. The system of claim 10, wherein said at least two feed horns comprise a combination of at least one metal horn and at least one dielectric rod feed.

15. A mobile antenna system in communication with multiple satellites for use with a moving platform, the system comprising:

a primary reflector coupled to an azimuth adjustment motor and an elevation adjustment motor, the primary reflector positioned to reflect at least two Ku band signals to a focal region of the primary reflector;

a feed horn assembly rotatably and mechanically coupled to the primary reflector, said feed horn assembly comprising at least two feed horns to receive the at least two Ku band signals;

a sub-reflector positioned to face the focal region of the primary reflector to reflect the at least two Ku band signals directed by the focal region of the primary reflector;

a motor driven mechanism configured to rotate an orientation of the feed horn assembly mechanically relative to the primary reflector, the rotation of the feed horn assembly being (i) substantially about a center axis of the primary reflector, and (ii) arranged to actively maintain alignment of one or more antenna beams associated with the Ku and Ka band signals with a geostationary orbital arc, the alignment being actively maintained relative to the moving platform; and a tracking controller configured to provide a motor control signal to the motor driven mechanism, the tracking controller configured to generate the motor control signal based on one or more attitude sensors associated with the moving platform and based on the received Ku band signal and the received Ka band signal, the tracking controller further configured to coordinate the motor control signal with one or more of an azimuth control signal configured control the azimuth adjustment motor and an elevation control signal configured to control the elevation adjustment motor.

16. The system of claim 15, wherein the system is capable of being mounted on a moveable platform.

17. The system of claim 15 wherein said at least two feed horns comprise metal horns.

18. The system of claim 15, wherein said at least two feed horns comprise dielectric rod feeds.

19. The system of claim 15 wherein said at least two feed horns comprise a combination of at least one metal horn and at least one dielectric rod feed.

20. The system of claim 1, wherein the feed horn assembly further includes a third feed horn, the third feed horn configured to receive the at least one Ka band signal.

21. The system of claim 20, wherein the motor driven mechanism is further configured to rotate the orientation of the feed horn assembly relative to the primary reflector to receive the at least one Ku band signal and the at least one Ka band signal by simultaneously aligning a respective polarization of the first, second, and third feed horns with a corresponding polarization of a first, second, and third satellite of the multiple satellites, respectively.

* * * * *